US005318498A

United States Patent [19]

Jones

[11] Patent Number: 5,318,498

[45] Date of Patent: Jun. 7, 1994

[54] URINALS

[76] Inventor: Kathie K. Jones, 5764 Red Cedar St., Pensacola, Fla. 32507

[21] Appl. No.: 19,009

[22] Filed: Feb. 18, 1993

Related U.S. Application Data

[62] Division of Ser. No. 779,416, Oct. 15, 1991, Pat. No. 5,224,222.

[51] Int. Cl.[5] ..... B31B 1/62

[52] U.S. Cl. ..... 493/115; 493/120; 493/154; 493/158; 493/220

[58] Field of Search ..... 493/63, 68, 74, 76, 493/77, 86, 93, 100, 115, 120, 152, 154, 155, 158, 162, 174, 176, 468, 473, 476, 344, 346, 356, 220

[56] References Cited

U.S. PATENT DOCUMENTS

| | | | |
|---|---|---|---|
| 4,235,160 | 11/1980 | Olney | 493/154 |
| 4,683,598 | 8/1987 | Jones | 4/301 |
| 4,985,940 | 1/1991 | Jones | 4/301 |

*Primary Examiner*—Jack Lavinder

*Attorney, Agent, or Firm*—Joseph C. Mason, Jr.; Ronald E. Smith

[57] ABSTRACT

A machine and method for making frusto-conical liners for a funnel of the type used on a urinal for female individuals. The liners are dispensed from a dispenser of the telescopic type so that pressing down on a top part of the dispenser releases a liner from the dispenser. The funnel lined by the liner is cradled in an improved funnel holder that includes an ejector that knocks a used liner off the funnel when the funnel is returned to the holder so that the user need not handle the liner. The machine that performs the method of making the liners includes a station where flat liners are removed from a stack of liners, spread open, and placed on a mandrel. The mandrel rotates to a second station where the liner is folded into its final configuration. The mandrel next rotates to a third station where the liner is heat treated, and the mandrel then rotates to a fourth station where the liner is removed from the machine and added to a stack of nested liners for subsequent charging into a dispenser.

10 Claims, 14 Drawing Sheets

URINALS

This is a divisional of copending application Ser. No. 07/779,416 filed on Oct. 15, 1991, now U.S. Pat. No. 5,224,222.

TECHNICAL FIELD

This invention relates, generally, to urinals for use by female individuals. More particularly, it relates to an improved funnel liner, an improved means for removing the funnel liner after use, an improved dispenser for the funnel liners, and a machine and method for making the liners.

BACKGROUND ART

The only urinal for females that has ever met with commercial success, anywhere in the world, was invented by the present inventor and two embodiments thereof are disclosed in U.S. Pat. Nos. 4,683,598 and 4,985,940. The device can take the form of a wall-mounted unit, as shown in the earlier patent, or it may be provided as a floor-mounted unit, as shown in the more recent patent.

The device, sold under the trademark She-inal by Urinette, Inc., includes a form-fitting funnel that is lined with a paper liner so that the funnel itself does not contact the user's body. The funnel is hung after use on a funnel holder, and an arm strategically positioned above the holder knocks the liner off as the funnel is being hung so that the user never needs to touch the liner.

The earlier device also includes a funnel dispenser that is operated by placing the funnel into the dispenser so that the rim of the funnel may engage a nested liner and remove it from the dispenser.

Thus, the earlier embodiments of the She-inal represent the most relevant prior art to the present invention. However, said earlier embodiments and devices created by others did not suggest to those of ordinary skill in this art how the art could be advanced at the time the present invention was made.

DISCLOSURE OF THE INVENTION

The improved She-inal includes an improved funnel liner, an improved means for removing the funnel liner from the funnel, an improved funnel liner dispenser, and a machine and method for making said improved liner.

The novel funnel liner has a unique shape that facilitates its removal from the funnel; it has a water-repellent exterior surface and an untreated interior surface.

The funnel holder is specifically constructed to require the user to insert the funnel into the holder in a particular way to hang up the funnel after use. An ejector arm of unique construction is specifically positioned relative to the holder so that the liner is knocked off the funnel as said funnel is hung on said holder.

The novel dispenser does not require that the funnel be inserted thereinto in order to apply a liner thereto. The dispenser includes a telescoping housing that dispenses a liner when the top of the housing is pressed downwardly.

The liner is made by a novel machine having two stages. The first stage dispenses two sheets of paper, one of which is water-repellent and one of which is not, from large supply rolls. A glue wheel applies glue to the sheets as they are unrolled, a cutting wheel applies perforation marks to the paper, and a separation roller breaks the perforated lines to thereby produce individual liners. The liners are placed into a stacking tube or tubes at the conclusion of the first stage; they are in a flattened condition at that time.

The second stage of the novel machine has four stations. The first station removes the liners from the stacking tube, one at a time, opens them into their general frusto-conical configuration, and places them onto a mandrel. Clamps associated with the mandrel clamp the liner and the mandrel rotates to a second station where the liner is folded into its final shape. The mandrel then rotates to a third station where the liner is heated and placed into its final, unwrinkled configuration. Finally, the mandrel rotates again and delivers the liner to a fourth station where it is removed from the machine for shipping.

The machine has four mandrels arranged in equidistantly and circumferentially spaced relation to one another; all four mandrels rotate about a common center. Thus, the functions performed at the second station are simultaneously performed with the functions performed at the first station, i.e., a new liner is removed from the stacking tube and spread open at the first station preparatory to its folding at the second station at the same time the folding operation of another liner is performed at the second station, and so on for all four stations, i.e., all steps of the novel process are performed simultaneously.

Accordingly, it is an important object of the present invention to advance the art of urinals for use by female individuals by providing an improved funnel liner and a machine for making it.

Another important object is to provide an improved means for removing a liner from a funnel and an improved means for dispensing the liners.

These and other objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODE FOR CARRYING OUT THE INVENTION

Figure 1:
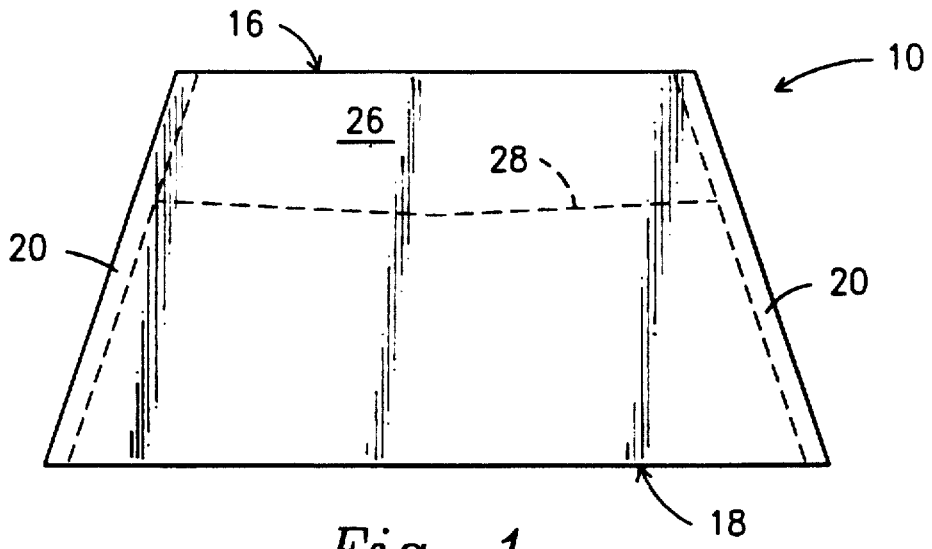
FIG. 1 is a side elevational view of the improved funnel liner before it is folded.
Figure 2:
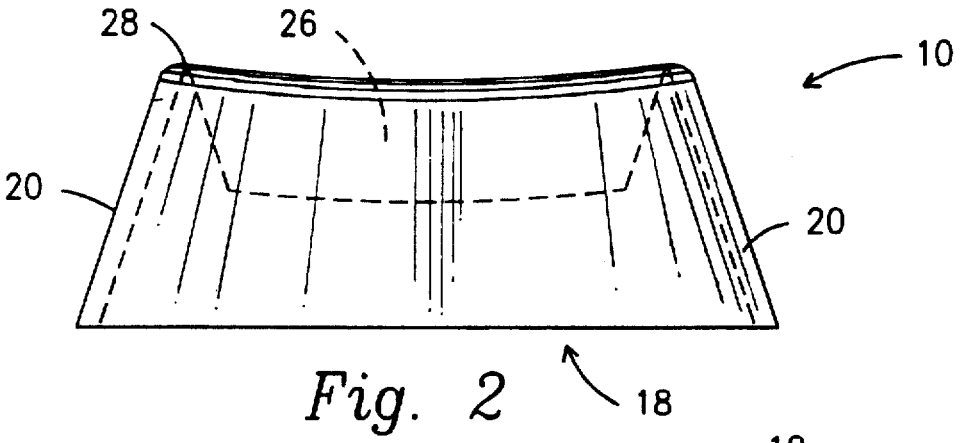
FIG. 2 is a side elevational view thereof after it has been folded.
Figure 3:
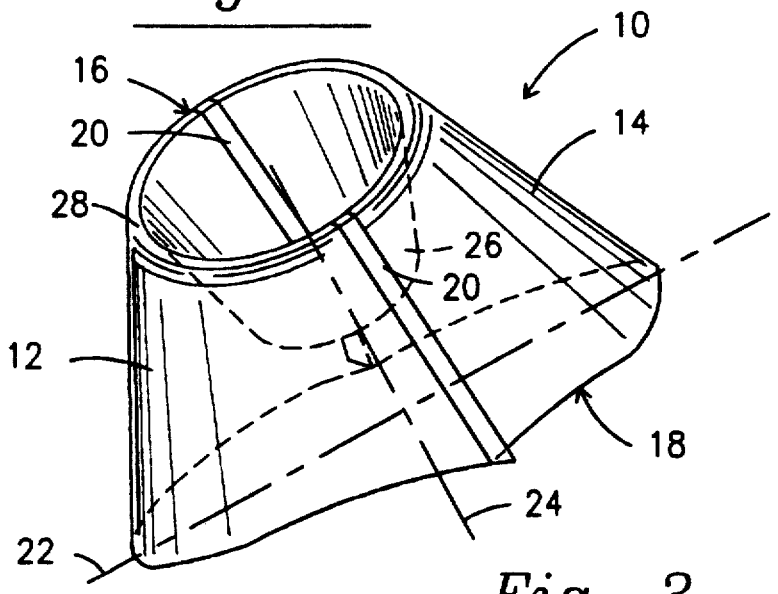
FIG. 3 is a perspective view of a folded funnel liner.

The novel liner, known commercially as the Total Guard, is denoted 10 as a whole in FIGS. 1-3. It is made in two parts 12 and 14 (FIG. 3) and has a frusto-conical configuration before it is folded as depicted in FIG. 1; it is open at top 16 and at bottom 18. The two parts are glued together along glue line 20 in the manner hereinafter indicated.

Note from FIG. 3 that liner 10 is not circular, i.e., it has a major axis 22 and a minor axis 24 transverse thereto so that it conforms to the shape of the funnel with which it is used. Note also by comparing FIGS. 1 and 2 how the upper part 26 of the paper is folded radially inwardly and downwardly along folding line 28.

FIGS. 4-8 depict, in animation, how a liner 10 is ejected from or knocked off its funnel after use. In those Figures the She-inal is denoted 56, the funnel is denoted 58, the funnel handle is denoted 60, and the elongate arm that interconnects the funnel and handle is denoted 62. Flexible hose 64 has a lowermost end, not shown, in fluid communication with a water-containing bowl of the type found in many bathroom fixtures; it defines a fluid passageway and performs the function of providing fluid communication between downspout 66 of funnel 58 and said bowl.

The novel ejector means includes a stationary ejector arm 68, a pair of laterally spaced apart guide members 70, only one of which may be seen in FIGS. 4-7 due to the side elevational aspect thereof, and a pair of funnel holder arms 72, of which only one appears in said Figures for said reason. The guide members 70 are formed integrally with their associated arms 72. A frontal view of these parts is provided in FIG. 8.

Figure 4:
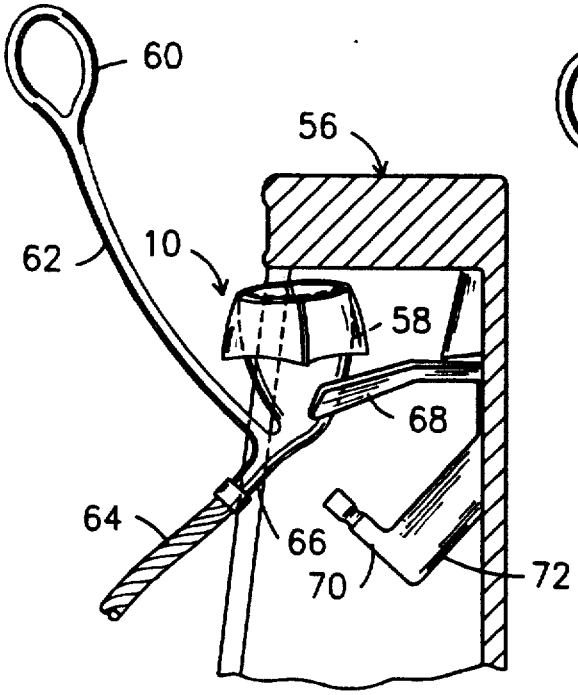
FIG. 4 is a side elevational view that is the first view of an animation including four views depicting how the novel ejector knocks the funnel liner from the funnel when the funnel is placed in its holder.
Figure 5:
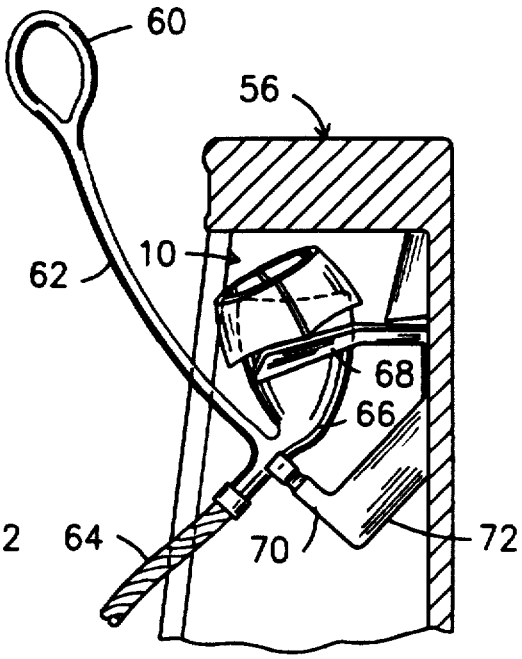
FIG. 5 is the second Figure in said series of animations.
Figure 6:
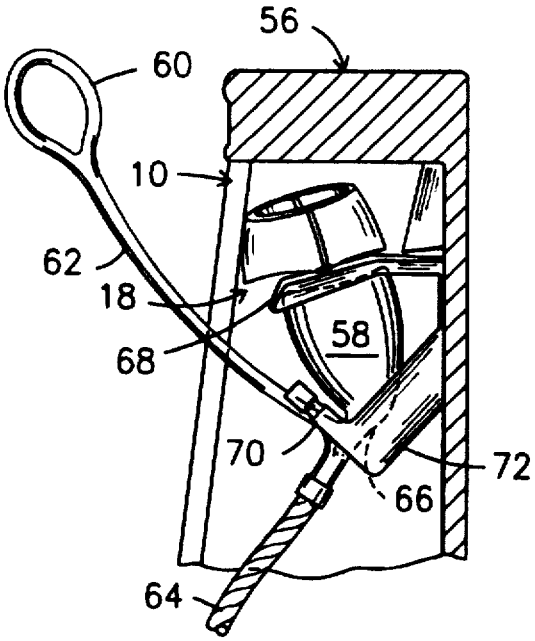
FIG. 6 is the third Figure in said series.
Figure 7:
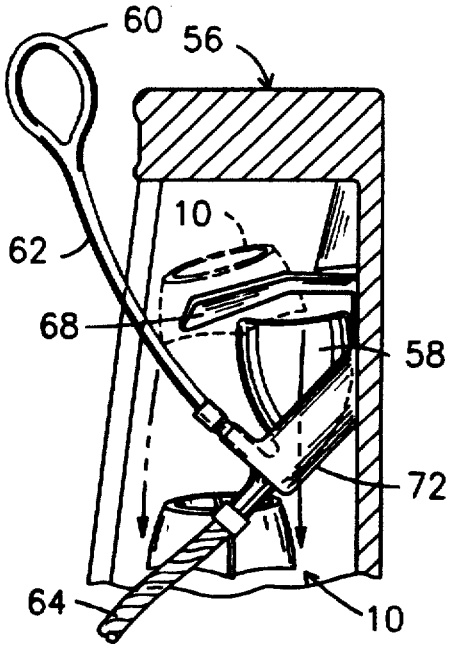
FIG. 7 is the fourth Figure in said series.
Figure 8:
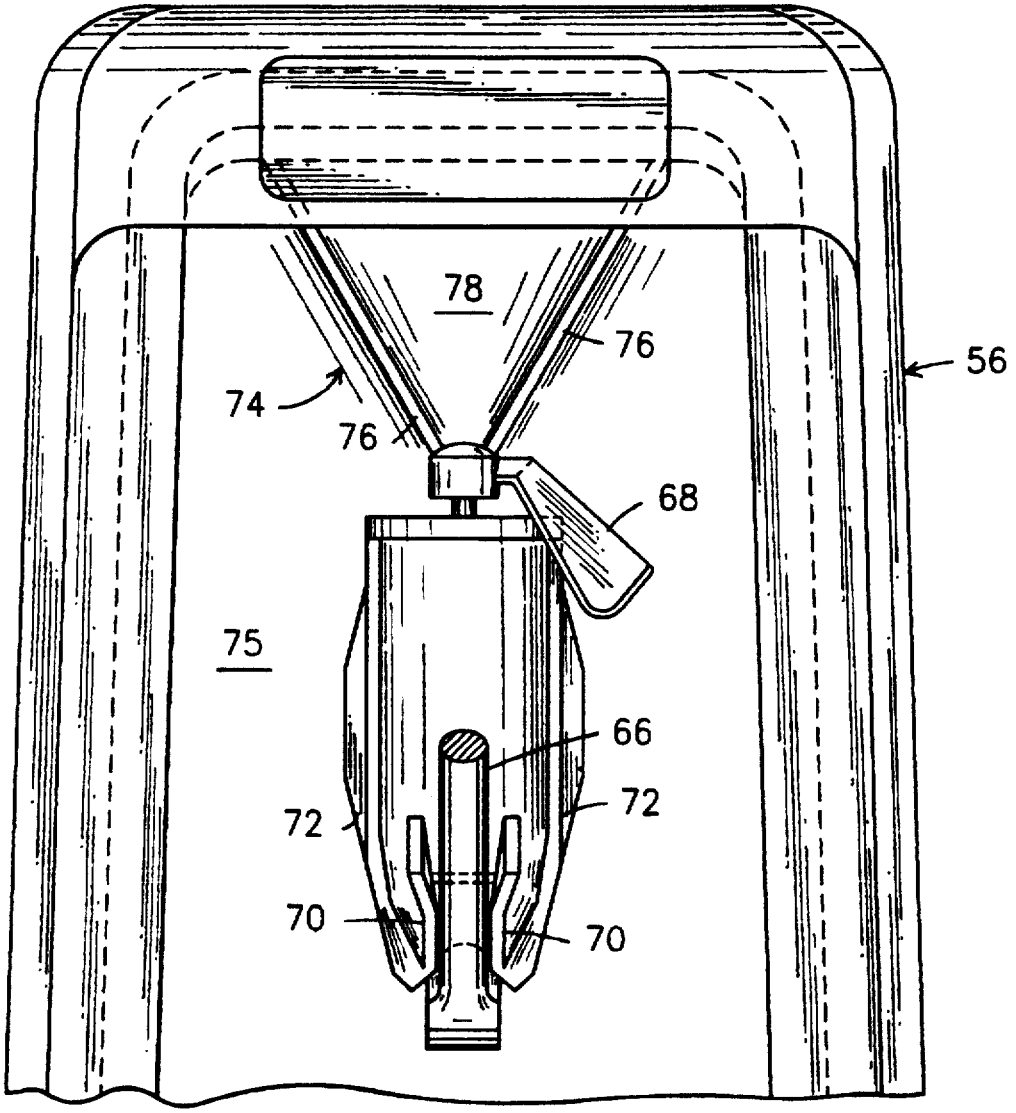
FIG. 8 is a front elevational view of the upper half of the novel urinal.

As perhaps best understood by observing FIGS. 4 and 8 together, the user is required to position the downspout 66 of funnel 58 between transversely spaced apart guide arms 70, 70 to hang or suspend the funnel between funnel holder arms 72, 72. This precise alignment of the funnel causes funnel liner 10 to impinge against ejector arm 68 as depicted in FIGS. 5 and 6; note in FIG. 8 that ejector arm 68 has a concavity formed along its extent to receive the lowermost edge of liner 10. FIG. 6 shows how the lowermost edge 18 of the funnel continues to slide inwardly, i.e., toward the back wall of the She-inal, along ejector arm 68 as the user continues the motion required to return the funnel 58 to its cradled position in holder arms 72, 72. In FIG. 7, the user has lowered the funnel 58 fully into its cradled position between arms 72, 72; liner 10 is thus no longer supported by the rim of funnel 58, and only one half of said liner is supported by ejector arm 68. Thus, the liner falls into the water-containing bowl below the holder arms 72, 72, as depicted in FIG. 7.

Figure 9:
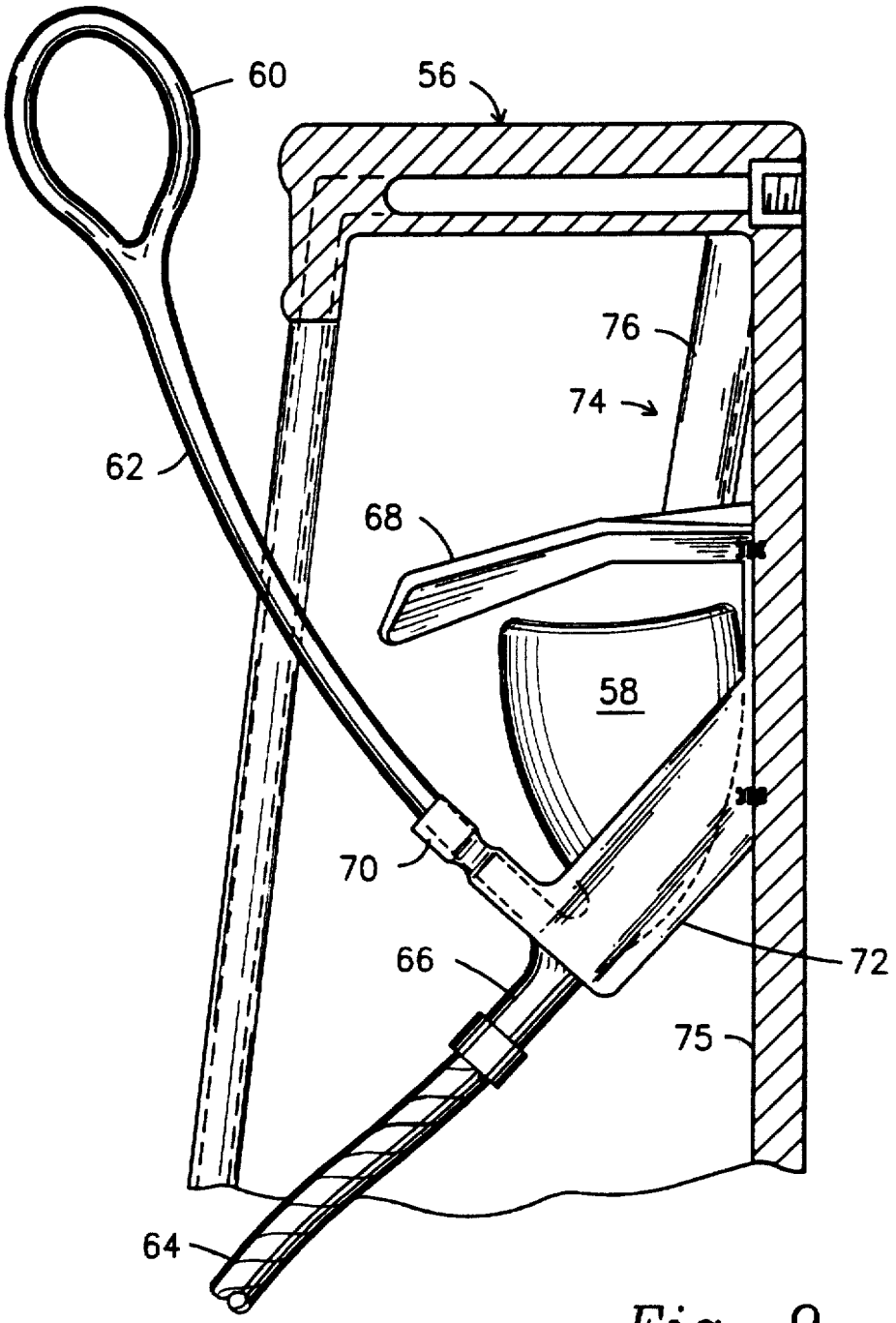
FIG. 9 is an enlarged version of FIG. 7 so that the construction of the novel apparatus is better seen.

FIG. 9 shows the funnel 58 in the same position as FIG. 7 and thus adds nothing further, but it does depict how the funnel assembly appears to the next user of the She-inal. That user will find it necessary to retrieve the funnel by lifting it from arms 72, 72, and guiding it between guide arms 70, 70 so that a new liner can be placed atop it. Thus, the act of removing the funnel teaches the user the motions that will be required to return it to its mount. Importantly, the user need not know how to remove the liner.

A means for directing a predetermined quantity of water into the hollow interior of funnel 58 to wash its interior side walls after each use is best shown in FIGS. 8 and 9 and is denoted 74. Means 74 is a trough having raised side walls 76, 76 and a concavity 78 therebetween. Water flows downwardly into the funnel and is focused by the converging sidewalls 76, 76 so that it does not splash beyond the confines of the interior of the funnel. It is also noteworthy that ejector arm 68 is spaced laterally outwardly of the narrowest, i.e., lowermost, part of trough 78 so that said ejector arm remains dry, as perhaps best shown in FIG. 8. The shading lines on both sides of sidewalls 76, 76 in FIG. 8 indicate that the raised sidewalls gradually merge with the back wall 75 of the She-inal.

Figure 10:
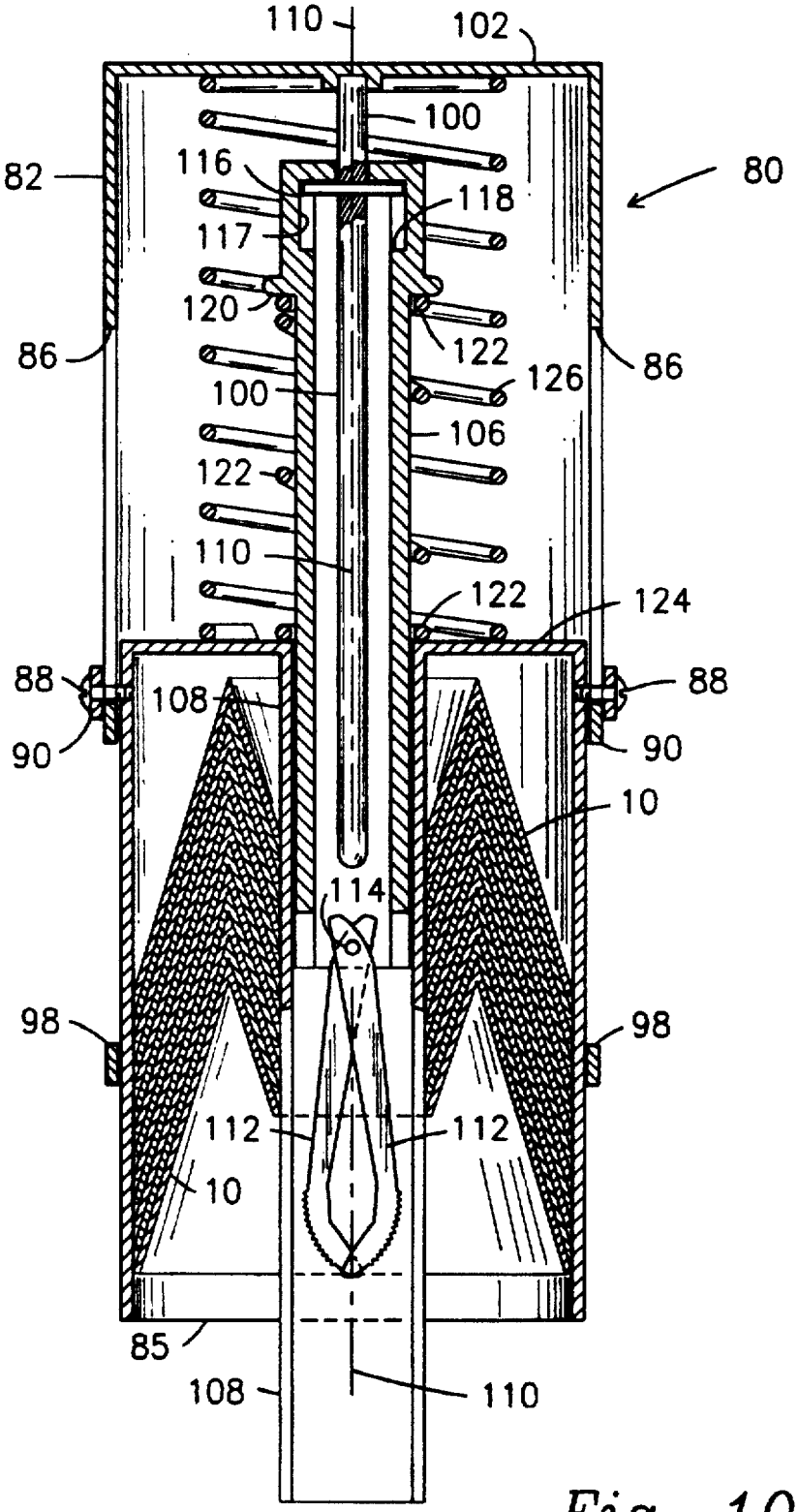
FIG. 10 is the first front sectional view of an animation including four views of the novel dispenser as it dispenses a liner.

FIGS. 10-13 provide an animation of the operation of the novel dispenser 80; said dispenser is shown in repose in FIG. 10. Dispenser 80 includes tubular outer housing 82 and tubular inner housing 84 that is telescopically received within outer housing 82. A pair of diametrically opposed slots 86 is formed in outer housing 82 and a pin or screw 88, 88 is disposed within each of said slots to prevent relative rotation of said housings when they are moved telescopically with respect to one another. Each screw 88 is held in a fixed position by an arm 90 associated therewith. Arms 90, 90, only one of which is shown in FIG. 14, form a part of bracket 92 that is secured to the wall 94 of the bathroom by fastening means 96. Arm 98 also cradles dispenser 80 to further stabilize its position.

Returning now to FIG. 10, it will there be seen that push pin 100 depends from top wall 102 of outer housing 82 so that said push pin is displaced downwardly, i.e., in the direction of arrow 104 (FIG. 11), when housing 82 is pressed downwardly by the individual operating the dispenser. Pin 100 is slidably received within a hollow push rod 106 and said push rod 106 is slidably or telescopically received within a sleeve 108 that forms a part of the inner housing 84. More particularly, push pin 100, push rod 106, and sleeve 108 are concentrically disposed with respect to one another and with respect to housings 82 and 84; moreover, said parts are centered along, i.e., coincident with, the longitudinal axis of symmetry 110 of dispenser 80. Note that sleeve 108 extends beyond the lowermost edge 85 of inner housing 84.

A pair of push legs 112, 112 are pivotally mounted with respect to one another and with respect to a transverse rod 114 that has its opposite ends secured to the lowermost end of push rod 106. The push legs hang freely in the position shown in FIG. 10 when dispenser 80 is in repose. Note that the uppermost or proximal end of the push legs are spaced just downwardly of the lowermost or distal end of push pin 100. Note also how the proximal ends of said push legs are curved in opposite directions.

A push pin detent means in the form of a washer 116 is captured within a cavity 117 formed in the uppermost end of push rod 106; a ledge or shelf 118 at the bottom of said cavity has a breadth less than the breadth of the cavity and prevents washer 116, which is fixedly secured to push pin 100, from traveling past said ledge.

A flange 120 circumscribes push rod 106 and provides a stop means for inner spring 122 that extends between the bottom of said flange 120 and the top wall 124 of inner housing 84; spring 122 provides a bias means for maintaining push rod 106 in its depicted position of repose, i.e., away from top wall 124, when no other forces are imparted against it.

Figure 12:
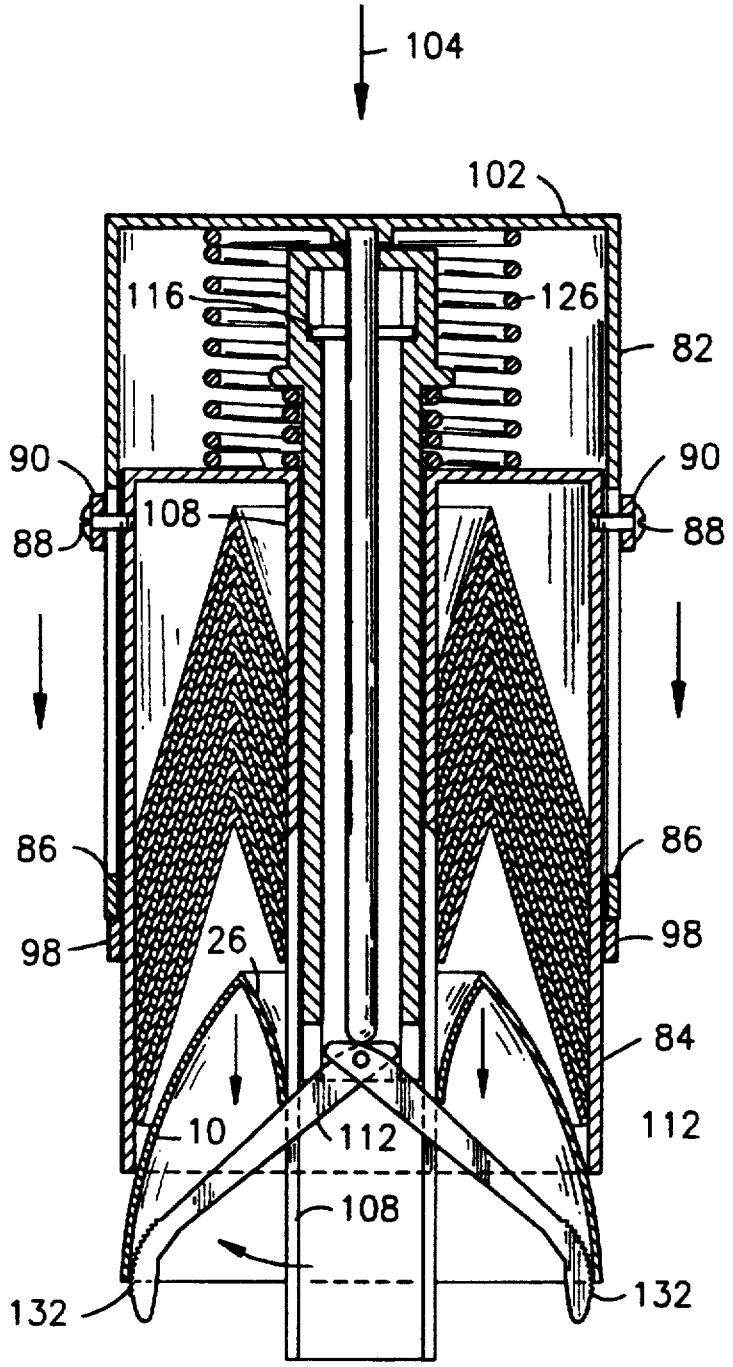
FIG. 12 is the third view of said series.

A larger, outer spring 126 extends between the top wall 102 of outer housing 82 and top wall 124 of inner housing 84; it maintains the dispenser assembly in the position of FIG. 12 and returns it to said position after externally imparted forces are removed therefrom.

A plurality of funnel liners 10 are stored in nested configuration within inner housing 84, in encircling relation to sleeve member 108. Said liners frictionally engage said sleeve 108 and the inner sidewall of inner housing 84.

To dispense a single funnel liner 10, the user presses down on top wall 102 of outer housing 82, thereby compressing large spring 126; a liner will drop out of the dispenser 80 and fall onto a funnel 58 positioned directly therebelow as more fully set forth hereinafter. The user then simply releases the pressure from the outer housing top wall and said large spring returns the dispenser to its position of repose (FIG. 10) so that it is ready for the next user.

Figure 11:
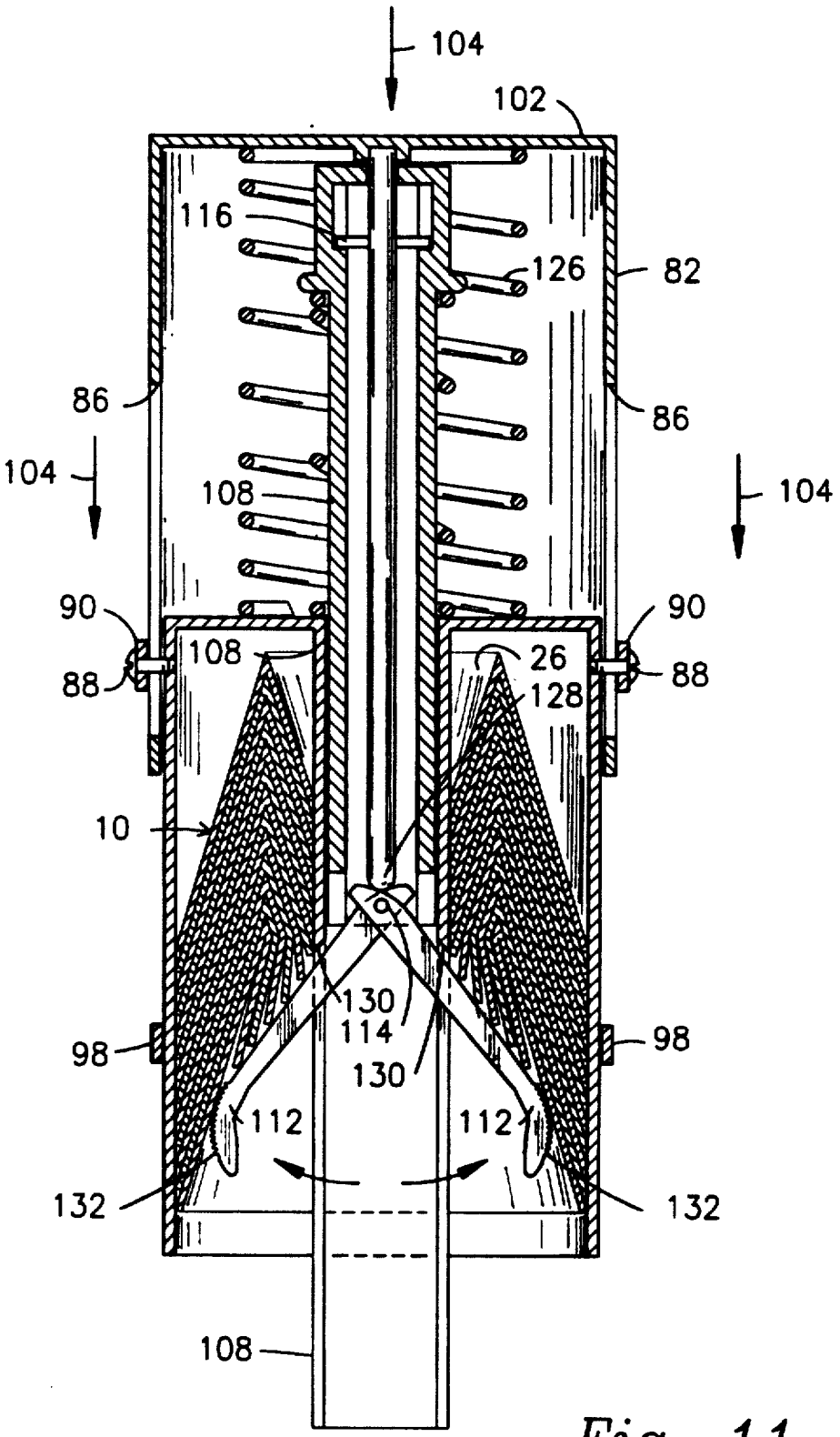
FIG. 11 is the second view of said series.

The position of the respective dispenser parts shortly after the downward displacement of outer housing 82 begins is shown in FIG. 11. Washer 116 now abuts ledge 118 so that further downward travel of outer housing 82 will result in simultaneous and corresponding downward travel of push rod 106; the position of push rod 106 and inner spring 122 is not affected as push pin 100 travels from its FIG. 10 position to its FIG. 11 position.

FIG. 11 shows that push legs 112, 112 are pivoted in opposite directions about pivot rod 114 when push pin 100 is driven in the direction of arrow 104 by the user's application of downward pressure atop outer housing 82. The distal or leading end 128 of the push pin 100 bears against the trailing or proximal curved end of each push leg 112, 112 and causes each leg to pivot radially outwardly as shown; diametrically opposed slots 130, 130 are formed in sleeve 108 to permit said movement of said push legs. When forced into their FIG. 11 position, the push legs bear against the lowermost funnel liner 10 in the nested stack of funnel liners, pressing said lowermost funnel liner against the interior side wall of inner housing 84. The bent part 132 of each leg 112 is knurled or otherwise roughened to enhance the grip of each liner by said legs.

The effects of further downward motion of outer housing 84 are depicted in FIG. 12. The lowermost liner 10 has now been partially removed from inner housing 82 and is now visible to the user, but it is still gripped by legs 112, 112. The size and rigidity of liner 10 are sufficient to retain it against knurled ends 132, 132 even when said liner is not backed by the sidewalls of the inner housing 84. Thus, as long as outer housing 82 is held down in the position of FIG. 12, push legs 112, 112 will continue to hold the lowermost funnel liner in the manner depicted.

Figure 13:
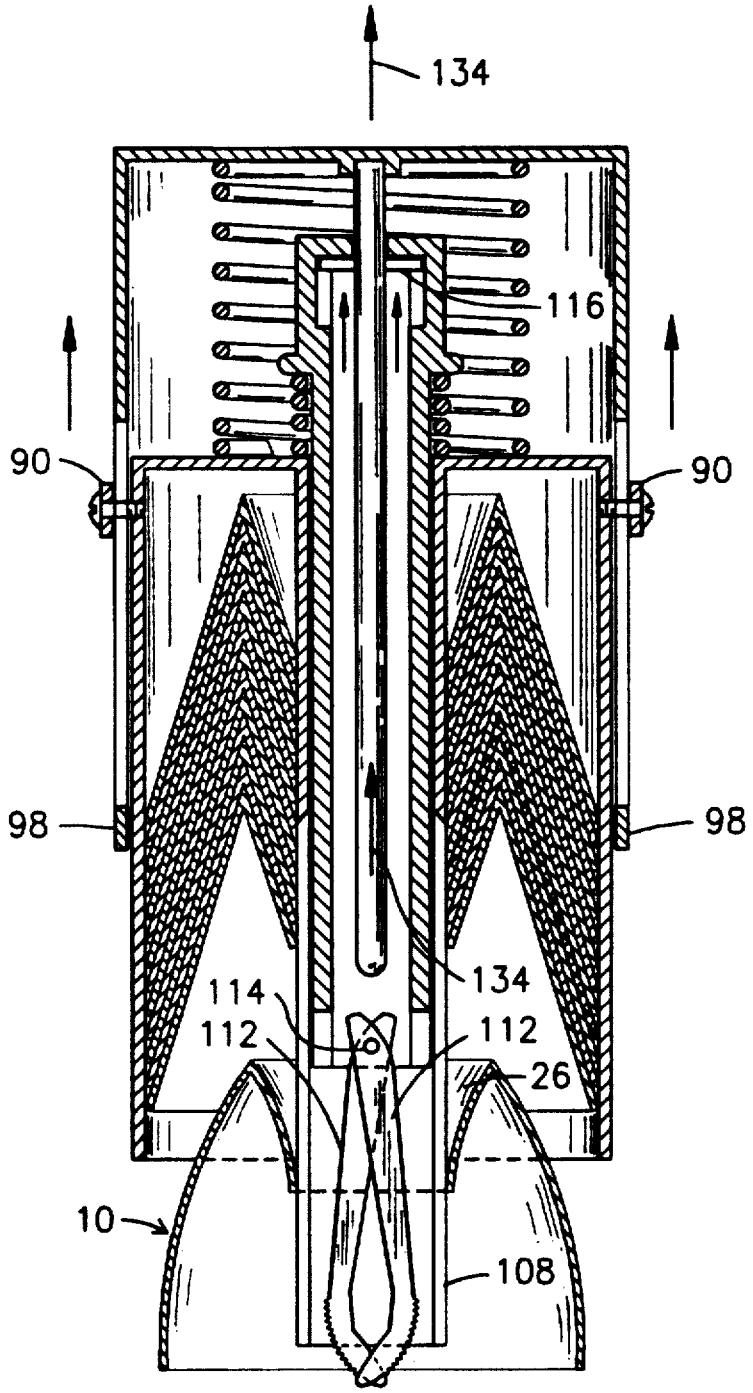
FIG. 13 is the fourth view of said series.
Figure 14:
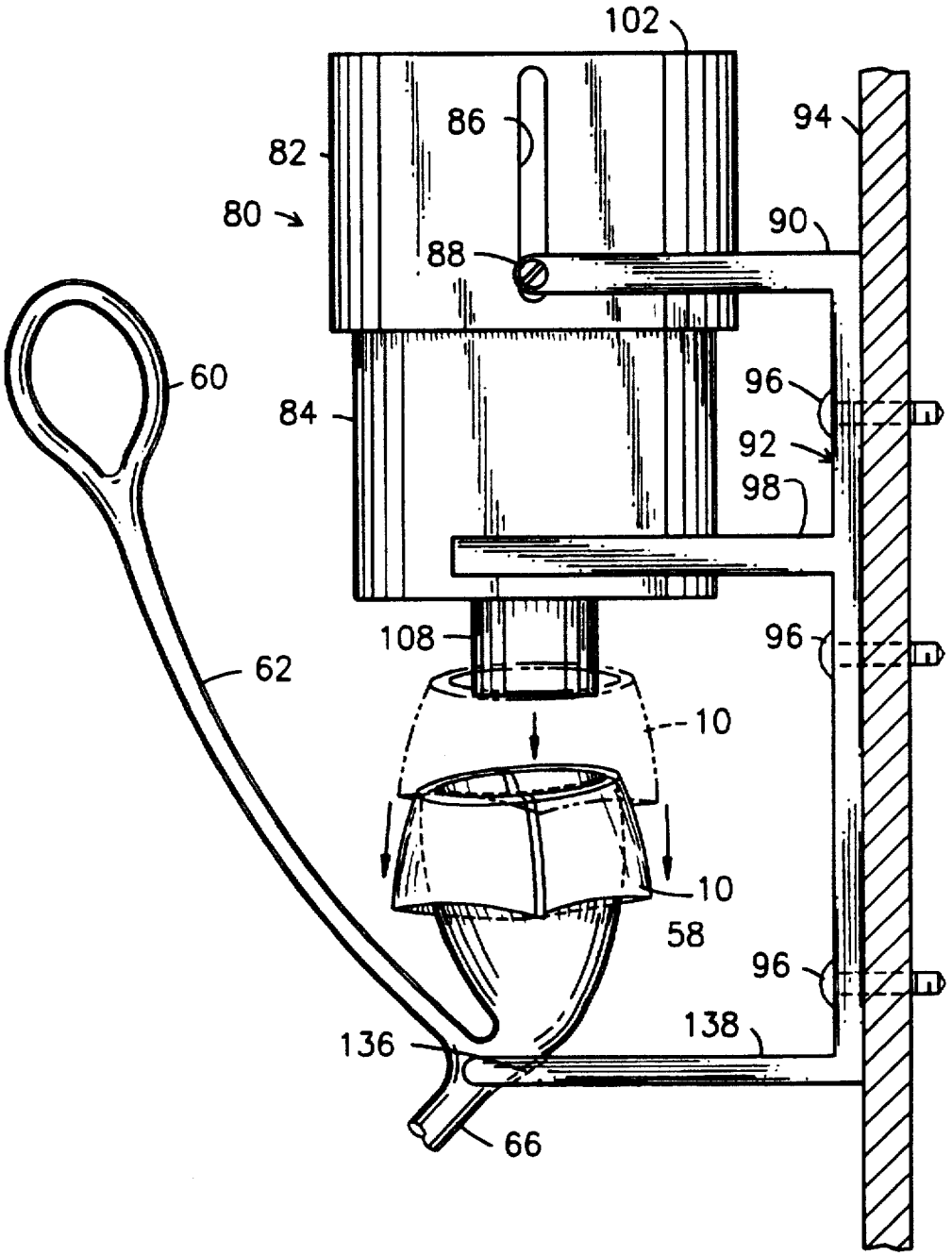
FIG. 14 is a side elevational view of the dispenser in its FIG. 10 position.

However, when the downwardly directed pressure applied to outer housing 82 is released, large spring 126 returns said outer housing to its position of repose; washer 116 is simultaneously carried upwardly until it abuts the top wall of push rod 106, as depicted in FIG. 13. Travel of push pin 100 in the direction indicated by directional arrow 134 causes said push pin to disengage from push legs 112, 112; said legs fall back, under the influence of gravity, to their respective positions of repose as depicted in FIG. 13. This allows liner 10 to fall under the influence of gravity onto funnel 58 which is positioned as depicted in FIG. 14.

More particularly, funnel 58 is positioned so that it abuts beveled surface 136 formed in laterally spaced arms 138, 138, only one of which may be seen, that form a part of bracket 92. Thus, to dispense a liner, the user places downspout 66 against said beveled surface 136 and presses down on outer housing 82. The entire procedure takes about a second. Sleeve 108 extends below the inner housing 84 to serve as a guide means that keeps each liner 10 centered with respect to the funnel as it falls from the dispenser.

Figure 15A:
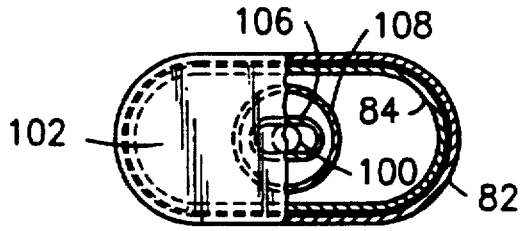
FIG. 15A is a sectional view of the dispenser taken along line 15A—15A in FIG. 15B.
Figure 15B:
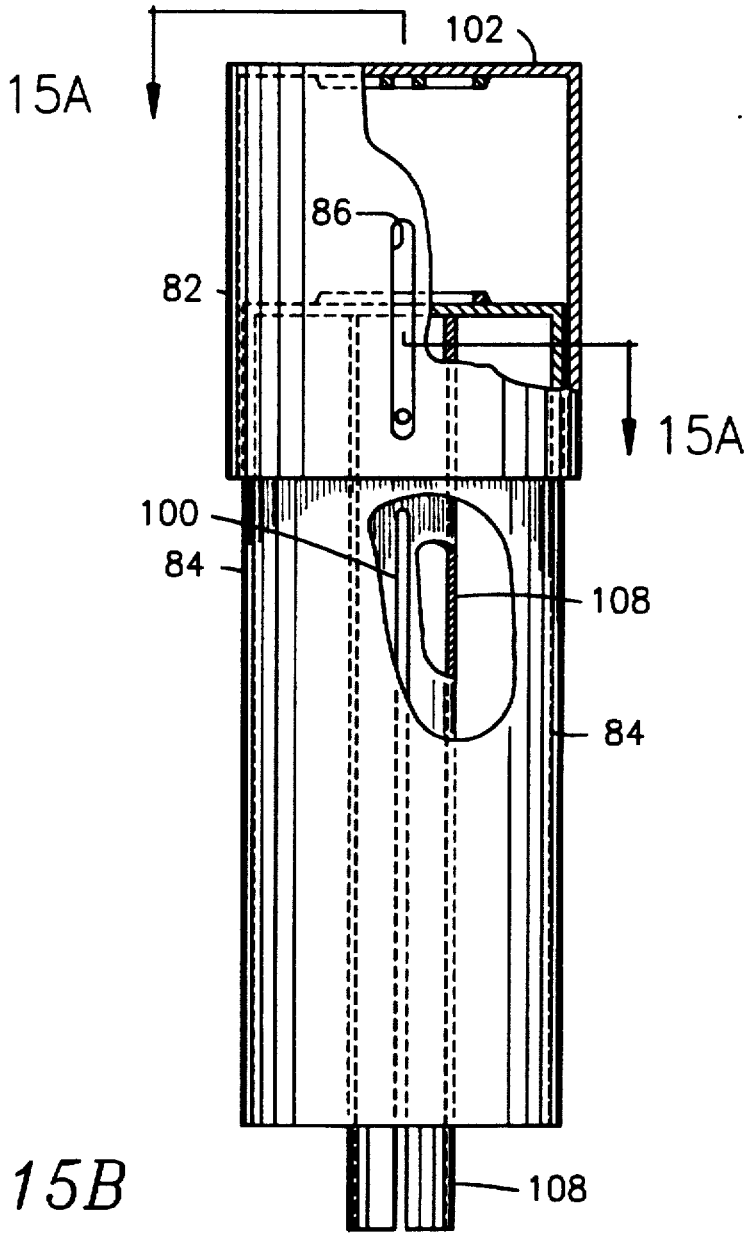
FIG. 15B is a side elevational, partially broken away view of the dispenser.

The dispenser has substantially the same shape in plan view as the liners it dispenses, as is clear from FIG. 15A. FIG. 15B shows how an actual dispenser appears; the dispenser of FIG. 14 is foreshortened.

Figure 16:
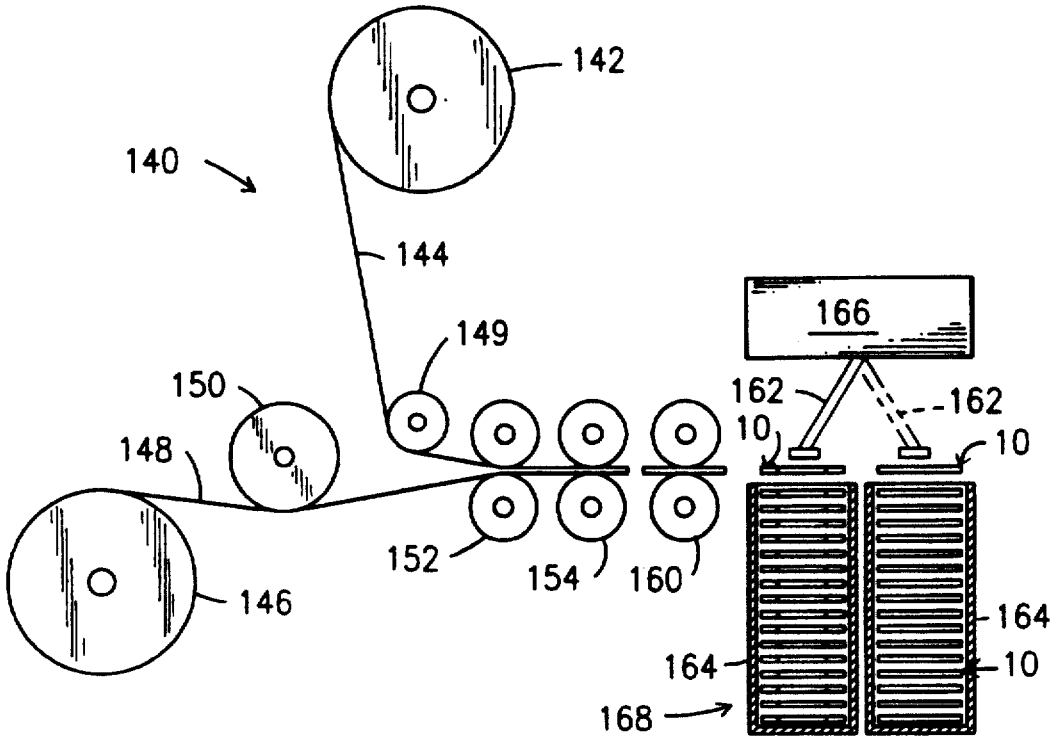
FIG. 16 is a side elevational, diagrammatic view of the first stage of the novel machine for making said funnel liner.

The first stage of the machine that is capable of making liners 10 quickly in large quantities is denoted 140 as a whole in FIG. 16. It includes first supply roller 142 having paper 144 coiled thereabout, and second supply roller 146 having paper 148 coiled thereabout. Glue is applied at longitudinally spaced intervals to an inner side of paper 148 by glue wheel 150 downstream of second supply roller 146 and suitable idle wheels 149 guide the two sheets of paper toward one another until they meet and adhere to one another along the generally transversely disposed adhesive strips 151 (FIG. 17) as depicted. In this way, as perhaps better understood in connection with FIG. 17, the top and bottom edges of the liner are not adhered to one another; this enables the flattened liners to be opened into a generally frustoconical configuration in the second stage of the machine.

Figure 17:
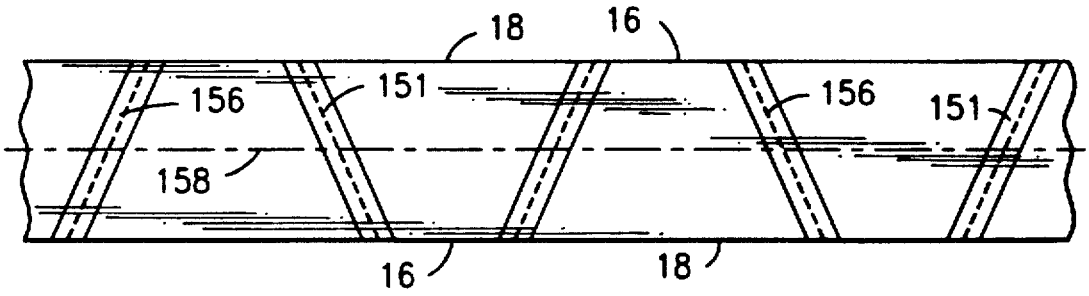
FIG. 17 is a top plan view of a perforated paper roll before it is separated along the perforations into individual liners.

Returning to FIG. 16, a cutter means 152 is shown diagrammatically. Rolls 142 and 146 hold paper about sixty inches in width; cutter means 152 cuts each sheet into plural strips of sheet material, each of which is four inches in width in the preferred embodiment of the liners. One of the strips of sheet material is shown in FIG. 17. Next, rollers 154 (FIG. 16) make perforations 156 (FIG. 17) at predetermined longitudinally spaced intervals along the extent of each strip. Each perforated line 156 bisects its associated adhesive strip 151 and is angled with respect to the longitudinal axis 158 of the sheet material to create a frusto-conical configuration when the liners are separated and spread open. Note that the liners are still in a flattened configuration in FIG. 17 and that they have a trapezoidal configuration. Note also that the narrow tops 16 and wide bottoms 18 of contiguous liners 10 alternate on opposite sides of symmetry line 158.

Separator rollers 160 (FIG. 16) are downstream of perforating rollers 154 and rotate at a higher rotational velocity than rollers 154; this breaks each strip of paper into individual funnel liners 10. It should be understood that the liners are in a flat or unopened condition at this point of the novel procedure, as depicted. The individual liners are then deposited into a stacking tube 164 of a pair of laterally disposed stacking tubes 168 in vertically stacked relation to one another to facilitate their subsequent removal therefrom. A sorting device 166 having a moveable arm 162 senses the liners as they are ejected from the separator rollers 160 and directs the liners into alternate stacking tubes, collectively denoted 168 as shown.

The second stage of the machine removes the flat liners from the stacking tubes, opens them into their FIG. 1 frusto-conical configuration, folds them into their final (FIGS. 2 and 3) configuration, applies a heat treatment thereto, and delivers them to a shipping station.

Figure 18:
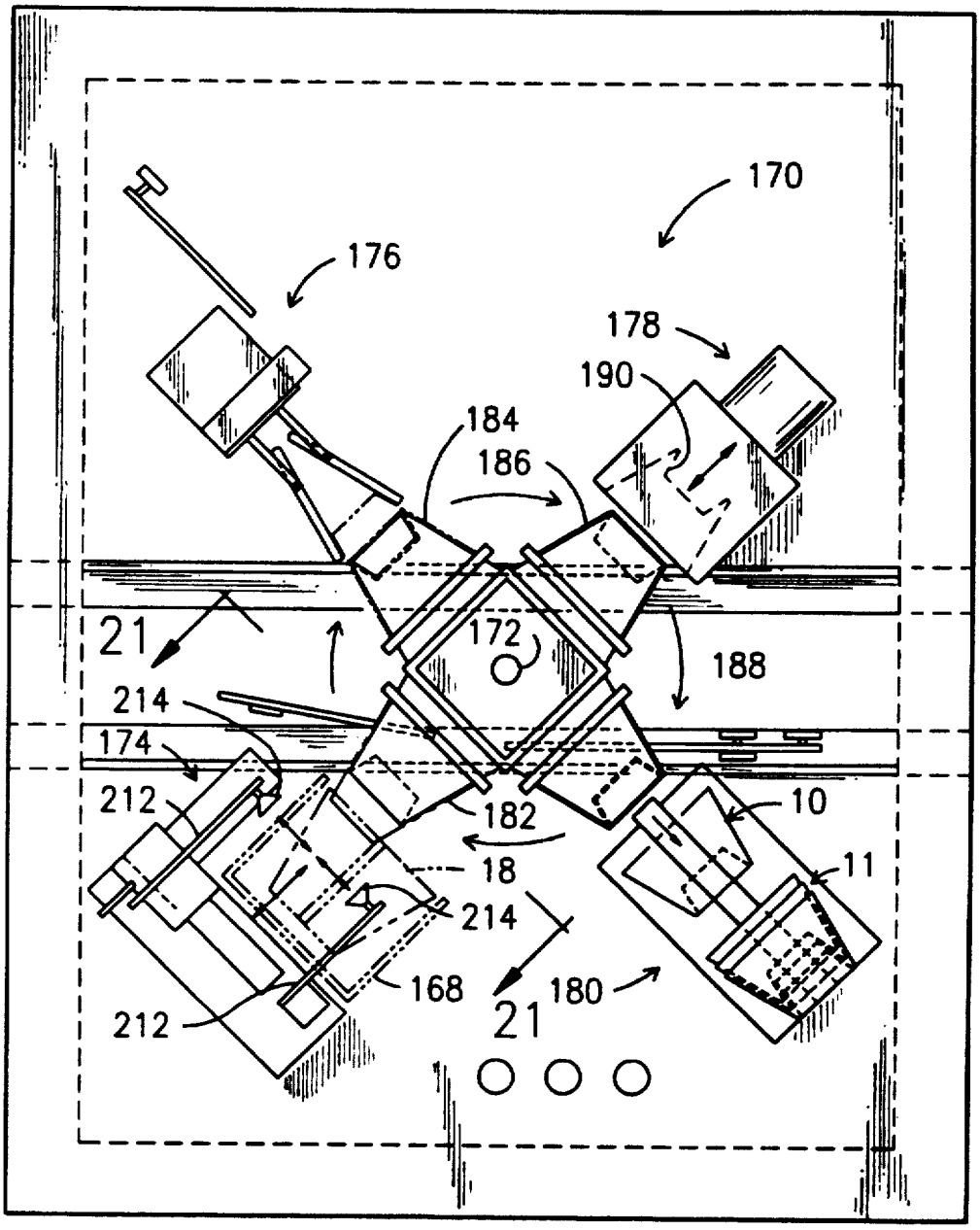
FIG. 18 is a top plan view of the second stage of the novel machine.

A top plan view of said second stage is provided in FIG. 18 and is denoted 170 as a whole. The second stage of the machine includes four fixed location stations that are radially disposed relative to central pivot axis 172; the stations are numbered 174, 176, 178, and 180, generally.

Four mandrels, denoted 82, 184, 186, and 188, are also positioned in radial relation to central axis 172; these mandrels rotate about central axis 172 and are positioned radially inwardly of the four stations as depicted. The rotation of the mandrels is governed by a suitable indexing means. The mandrels do not rotate as the operations are being performed at the stations, but do rotate between operations so that the process performed by the machine is substantially continuous.

At station one, reference numeral 174, a liner is removed from a stacking tube 168, rotated so that its wide lower end 18 is oriented toward mandrel 182 as shown in phantom lines in FIG. 18, spread open and placed on the mandrel. The spreading and placement action is performed by a pair of transversely spaced arms, collectively denoted 212, each of which has a suction cup 214 affixed to the free end thereof. Clamps then grasp the liner 10 to maintain it on the liner and said mandrel 182 then rotates one index amount so that it attains the position of mandrel 184 in FIG. 18. A more detailed disclosure of what happens at the first station will be provided below in connection with FIGS. 21 and 22.

At the second station 176, the funnel liner is folded and mandrel 182 rotates into the position occupied by mandrel 186 in FIG. 18.

At that third station, the liner is heat treated so that is assumes its final shape and quality.

The mandrel then rotates to the fourth station 180 where means are provided for taking the completed liner from the mandrel and loading it into a stack 11 of nested liners.

Figure 19:
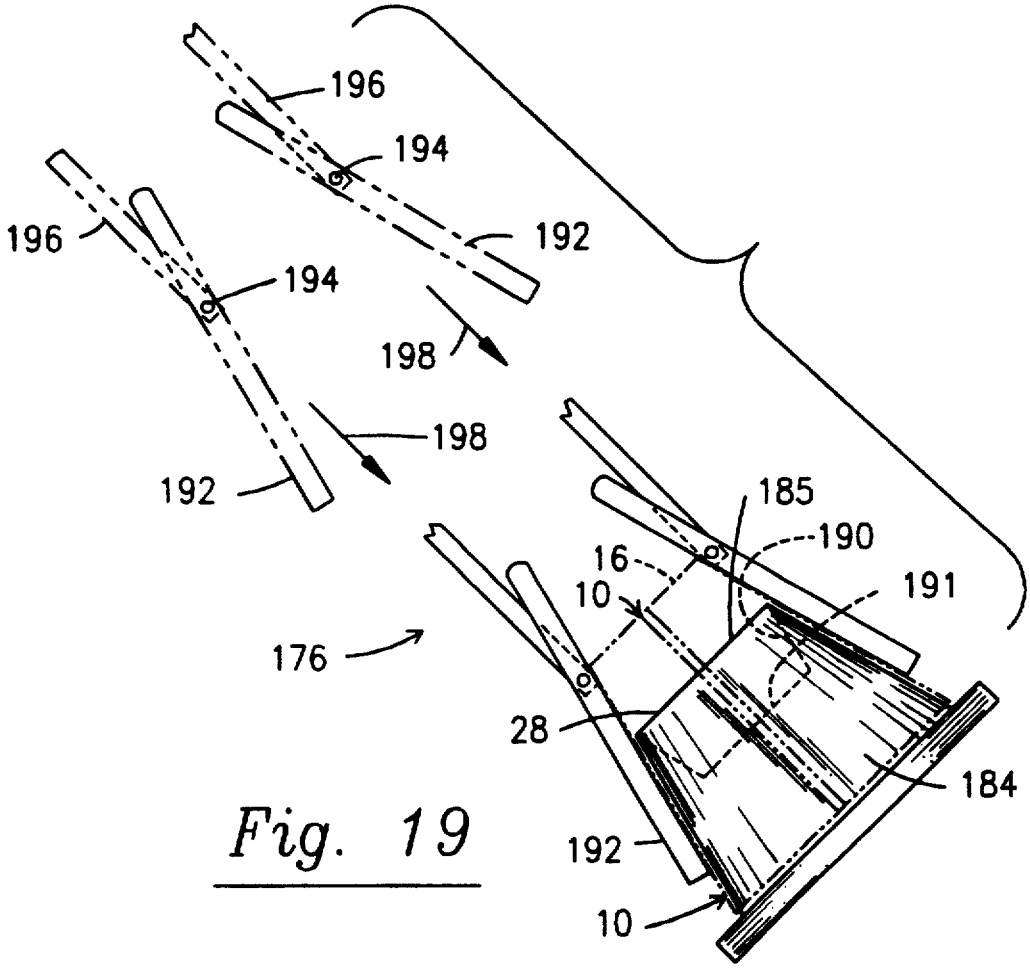
FIG. 19 is a top plan view of the second station of said machine showing a sequence of operations.
Figure 20:
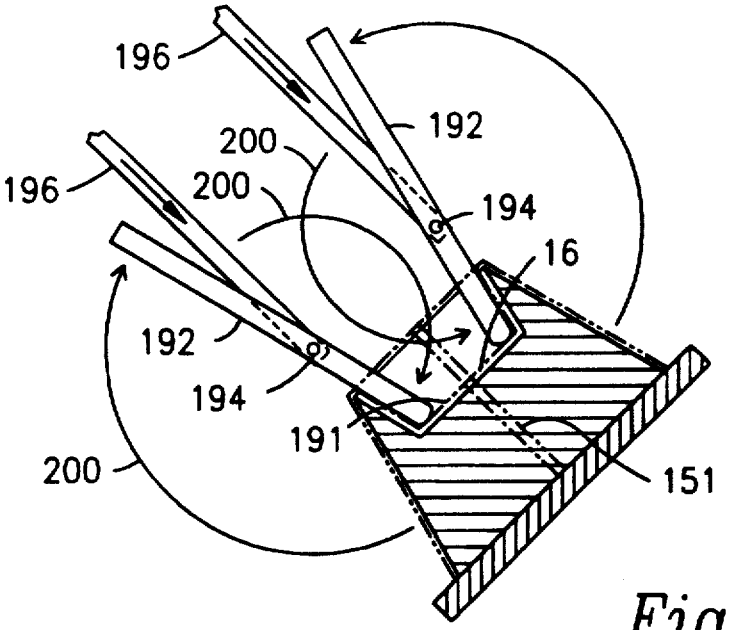
FIG. 20 is a top plan view of said second station, showing another step in the sequence of operations performed at that stage.

FIGS. 19 and 20 better depict what happens at station number 2, reference numeral 176. It is critical to note at the outset that the liner 10 in its unfolded, FIG. 1 configuration, which configuration is shown in phantom lines in FIGS. 19 and 20, has a greater depth than the depth of mandrel 184. Thus, folding line 28 is coincident with the radially innermost edge 185 of mandrel 184, i.e., the part of the liner to be folded extends radially outwardly beyond the mandrel as shown. Recess 190 in the mandrel serves as a molding means, as will be seen, for said extending part of said liner.

A pair of pivotally interconnected folding means are in a retracted position, depicted in phantom lines, when the liner arrives at the position occupied by mandrel 184. Folding arms 192, 192 are pivotally mounted as at 194, 194 to base arms 196, 196 that terminate just beyond pivot points 194, 194. When the mandrel comes to a stop, base arms 196, 196 advance radially inwardly as indicated by directional arrows 198, 198. The angle between the base arms and the folding arms is the same as the angle of the side walls of the liner and the mandrel so that said folding arms receive the liner therebetween as the base arms are so advanced. The base arms 196, 196 continue to advance until they attain their FIG. 20 position. When said FIG. 20 positioned has been attained, folding arms 192, 192 rotate simultaneously about their respective pivot points 194, 194 in the respective directions indicated by the directional arrows 200, 200 in FIG. 20. By comparing FIGS. 19 and 20, it will be appreciated that this action folds the liner along folding line 28 so that the top edge 16 of the liner is adjacent the bottom wall 191 of recess 190 as shown in FIG. 20. The folding procedure is completed by a reverse pivoting of the folding arms and a retraction of the base arms into their FIG. 19 positions so that the sequence can be repeated when the mandrels next index.

A more detailed depiction of how the earlier-mentioned steps performed at station number I, reference numeral 174, are carried out, appears in diagrammatic form in FIGS. 21A–21D and FIG. 22. FIGS. 21A–21D are taken along line 21—21 in FIG. 18 at different steps of the novel method.

Figure 21A:
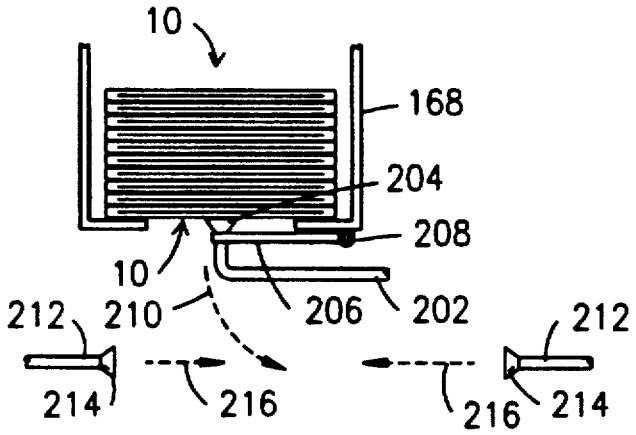
FIG. 21A is a side elevational view of the first station of said second stage, and is the first view in an animation of four views showing the steps performed at said first station, all of said views being taken along line 21—21 in FIG. 18.
Figure 21B:
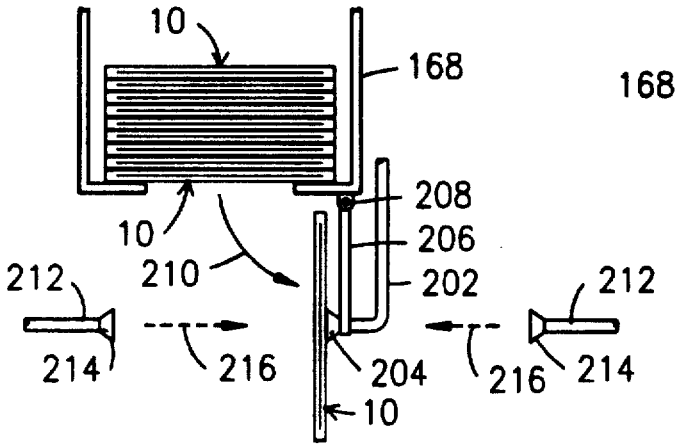
FIG. 21B is the second view of said series of views.
Figure 22:
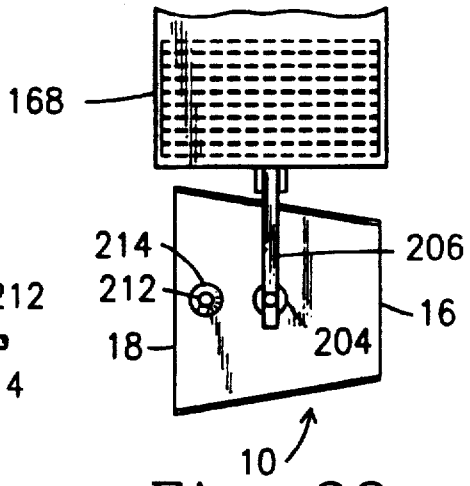
FIG. 22 is a side elevational view of FIG. 21B.
Figure 21C:
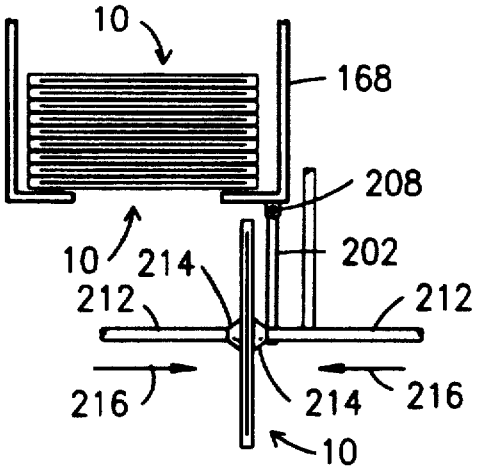
FIG. 21C is the third view of said series.
Figure 21D:
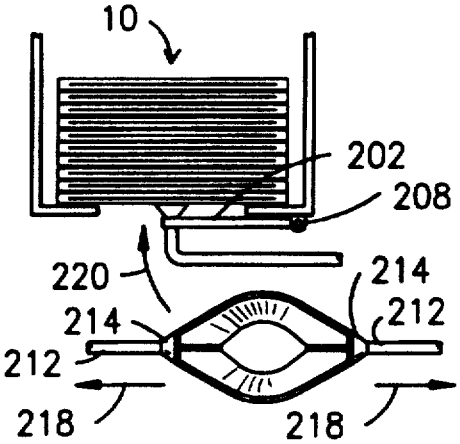
FIG. 21D is the fourth view of said series.

Flexible hose 202 has a suction cup 204 at its free end and is held by control arm 206; arm 206 is mounted for rotation about pivot point 208. When a negative pressure appears in hose 202, suction cup 204 engages the lowermost liner in the stacking tube 168 as depicted in FIG. 21A. Arm 206 then swings downwardly ninety degrees as indicated by directional arrows 210 in FIGS. 21A and 21B; the vacuum is maintained so that the lowermost liner 10 is thereby separated from the bottom of the stacking tube and held in a vertical plane as depicted in FIGS. 21B and 22. Hollow spreader arms 212 having suction cups 214 then converge toward one another from opposite sides of liner 10 as indicated by directional arrows 216 in FIG. 21B and engage said liner near its wide end 18, as best understood in connection with FIG. 22. The liner is then engaged by said suction cups 214, 214 as shown in FIG. 21C and a negative pressure is created in spreader arms 212, 212. The liner is then opened in the manner depicted in FIG. 21D, i.e., arms 212, 212, with the vacuum therein maintained, diverge from one another as indicated by directional arrows 218, 218. Note that control arm 202 returns to its FIG. 21A position, as indicated by arrow 220 in FIG. 21D so that the cycle can be repeated. Arms 212, 212 then travel toward mandrel 182, i.e., in a direction out of the plane of the paper, toward the viewer, and deposit the liner thereon for subsequent handling in the manner already described.

This invention is clearly new and useful. Moreover, it was not obvious to those of ordinary skill in this art at the time it was made, in view of the prior art considered as a whole as required by law.

Moreover, this invention pioneers the art of making funnel liners for urinals, and the art of dispensers therefor. Accordingly, the claims that follow are to be interpreted broadly to protect from piracy the heart or essence of this breakthrough invention.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A method of making a funnel liner, comprising the steps of:

placing a first flat sheet of material into overlying relation to a second flat sheet of material so that peripheral borders of said first sheet are in registration with peripheral borders of said second sheet;

cutting said first sheet so that it has a trapezoidal configuration and a predetermined size;

simultaneously cutting said second sheet so that it has the same configuration as said first sheet and the same predetermined size;

joining said first and second sheets together at lateral edges thereof, leaving respective top and bottom edges thereof unattached to one another;

spreading open said first and second sheets, thereby forming them into a generally oblong, generally frusto-conical configuration having a major axis and a minor axis; and.

folding a top edge of said first and second sheets radially inwardly and downwardly, said folding producing a generally oblong fold line that circumscribes said funnel liner coincident with a top edge of the completed funnel liner.

2. A method of making funnel liners, comprising the steps of:

supplying a first web of material from a rotatably mounted first reel;

supplying a second web of material from a rotatably mounted second reel;

applying an adhesive to a preselected web of said first and second webs at longitudinally spaced intervals along the extent thereof, each of said adhesive applications being generally transverse to the longitudinal axis of said preselected web;

guiding said first and second webs into registration with one another so that said first web overlies said second web and so that the respective longitudinal edges of said webs coincide with one another;

forming perforation lines in said webs by perforating said webs at each area of adhesive application;

separating said webs into individual liners along said perforation lines;

depositing each individual liner into at least one stack of liners;

retrieving said liners, one at a time, from said at least one stack of liners;

opening said liners from a flat configuration to a generally frusto-conical configuration; and folding an uppermost end of each of said liners radially inwardly and downwardly.

3. A machine for making funnel liners, comprising:

a first rotatably mounted supply roll of material;

a second rotatably mounted supply roll of material;

a rotatably mounted glue wheel for applying a generally transversely disposed strip of an adhesive at longitudinally spaced intervals along one of the first or second webs of material unrolled from web supply rolls;

means for placing web material from said first supply roll into contacting relation with web material from said second supply roll after said adhesive has been applied so that said webs are adhered to one another at longitudinally spaced intervals;

a rotatably mounted perforating wheel for forming longitudinally spaced, generally transversely disposed perforations in both webs, after said adhesive has been applied, said perforations being coincident with said strips of adhesive;

separating means for separating individual funnel liners along the perforations formed in said sheets;

sorting means for depositing the separated funnel liners, in a flat condition, into at least one stacking tube removal means for removing liners, one at a time, from a lowermost end of a stack of said liners in said at least one stacking tube;

spreading means for opening said funnel liners, after removal, into a generally frusto-conical configuration; and folding means for folding said funnel liners along a predetermined folding line so that a top edge of said funnel liner is positioned radially inwardly and downwardly within the frusto-conical configuration.

4. The machine of claim 3, further comprising means for heat treating said funnel liners after they have been folded and means for removing completed funnel liners from the machine.

5. The machine of claim 4, wherein said removal means comprises a pivotally mounted control arm, a flexible hose held by said control arm, and a suction cup at a free end of said hose, whereby said suction cup is positioned against a lowermost funnel liner in a stack of liners in said at least one stacking tube, a negative pressure is applied thereto, and said control arm is pivoted into a preselected position to prepare said funnel liners for spreading, said control arm carrying said lowermost funnel to said preselected position.

6. The machine of claim 5, wherein said spreader means includes a pair of hollow spreader arms that are initially positioned on opposite sides of a funnel liner in said preselected position, there being a suction cup mounted on a free end of each of said spreader arms, and said spreader arms being in fluid communication with a source of negative pressure, whereby a funnel liner is spread open by being engaged on opposite sides by said suction cups when a negative pressure is maintained in said spreader arms and said spreader arms are moved away from one another.

7. The machine of claim 6, further comprising a rotatable turret having at least one mandrel, said first mandrel positioned radially inwardly of said spreader arms, and wherein said spreader arms are also mounted for radially inward movement so that spreader arms may deposit a spread open funnel liner onto said first mandrel at a first station.

8. The machine of claim 7, further comprising a second, third and fourth mandrel positioned on the turret in circumferentially spaced relation to one another and to said first mandrel, said means for folding said funnel liner being positioned adjacent to and radially outwardly of said second mandrel at a second station, said means for heat treating said funnel liner being positioned adjacent to and radially outwardly of said third mandrel at a third station, and said means for removing said funnel liner from the machine being positioned adjacent to and radially outwardly of said mandrel at a fourth station.

9. The machine of claim 3, wherein said means for folding said liners further comprises a pair of laterally spaced base arms, a folder arm pivotally mounted to each said base arms, and a recess means formed in a radially outward end face of each mandrel for receiving the radially inwardly and downwardly folded part of a liner.

10. A device for folding liners of frusto-conical configuration, comprising:

said mandrel having a frusto-conical configuration;

said mandrel having a narrow radially outwardly disposed first end relative to the turret axis;

said mandrel having a wide second end opposite said first end;

said mandrel having a frusto-conical sidewall that extends between said first and second ends;

a frusto-conical recess formed in the face of the narrow first end of said mandrel, said recess having a narrow bottom and a wide open top end;

a pair of laterally spaced, movably mounted base arms;

said base arms being initially positioned radially outwardly of said mandrel in remote relation thereto;

a folder arm pivotally mounted to each of said base arms;

said folder arms being initially positioned at an angle substantially equal to the angle of the frusto-conical sidewall of said mandrel;

said a means for moving from the initial position to a position base arms disposed in proximal relation to said mandrel; and means for rotating said folder arms about their respective pivotal connections with said base arms in a direction toward one another so that a radially outermost part of a liner disposed in overlying relation to said mandrel is folded into said recess.

* * * * *